US011020992B2

(12) United States Patent
Yamashita et al.

(10) Patent No.: US 11,020,992 B2
(45) Date of Patent: Jun. 1, 2021

(54) PRINTING APPARATUS AND METHOD OF DETECTING POSITION OF SUPPORT PORTION

(71) Applicant: SEIKO EPSON CORPORATION, Tokyo (JP)

(72) Inventors: Norihiro Yamashita, Shiojiri (JP); Yoshihiko Momose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/813,996

(22) Filed: Mar. 10, 2020

(65) Prior Publication Data

US 2020/0290375 A1 Sep. 17, 2020

(30) Foreign Application Priority Data

Mar. 12, 2019 (JP) ..... JP2019-044873

(51) Int. Cl.

| | |
|---|---|
| ***B41J 11/14*** | (2006.01) |
| ***B41J 11/20*** | (2006.01) |
| ***B41J 11/06*** | (2006.01) |
| ***B41J 29/393*** | (2006.01) |

(52) U.S. Cl.

CPC ..... *B41J 11/20* (2013.01); *B41J 11/06* (2013.01); *B41J 11/14* (2013.01); *B41J 29/393* (2013.01)

(58) Field of Classification Search

CPC ... B41J 11/06; B41J 11/14; B41J 11/20; B41J 29/393; B41J 29/38; B41J 29/023; B41J 29/13

See application file for complete search history.

(56) References Cited

U.S. PATENT DOCUMENTS

2018/0162148 A1* 6/2018 Komiya ..... B41J 3/4078
2020/0276840 A1* 9/2020 Momose ..... B41J 25/304

FOREIGN PATENT DOCUMENTS

JP 2006-240107 * 9/2006 ..... B41J 11/16
JP 2013-252923 12/2013

OTHER PUBLICATIONS

Machine translation of JP 2013-252923, published on Dec. 2013 (Year: 2013).*
Machine translation of JP 2006-240107, published on Sep. 2006 (Year: 2006).*

* cited by examiner

*Primary Examiner* — Huan H Tran
(74) *Attorney, Agent, or Firm* — Workman Nydegger

(57) ABSTRACT

Provided is a printing apparatus including a support portion configured to support a medium, a printing unit configured to carry out printing onto the medium supported by the support portion, a support portion moving unit configured to move at least a part of the support portion in a facing direction in which the support portion and the printing unit face each other to change a support position of the medium in the facing direction, a detected unit having position information in the facing direction, the detected unit being configured to move in the facing direction together with the support portion, a detector configured to detect the position information, and a control unit configured to detect a position of the support portion in the facing direction, based on the position information detected by the detector.

9 Claims, 14 Drawing Sheets

PRINTING APPARATUS AND METHOD OF DETECTING POSITION OF SUPPORT PORTION

The present application is based on, and claims priority from JP Application Serial Number 2019-044873, filed Mar. 12, 2019, the disclosure of which is hereby incorporated by reference herein in its entirety.

BACKGROUND

1. Technical Field

The present disclosure relates to a printing apparatus and a method of detecting a position of a support portion.

2. Related Art

Printing apparatuses of various configurations have been used. Such printing apparatuses include a printing apparatus that includes a support portion configured to support a medium and that is configured to change a position of the support portion in a direction in which the support portion and a printing unit face each other. For example, JP-A-2013-252923 discloses a recording device configured to rotate a lever to move, in an attachment/detachment direction in which a set tray and a recording head face each other, a mounting attachment provided with the set tray configured to support a medium.

The position of the support portion in the direction in which the support portion and the printing unit face each other can be useful information when printing is carried out. However, in a typical printing apparatus including a support portion configured to support a medium, such as the recording device described in JP-A-2013-252923, the position of the support portion in the direction in which the support portion and the printing unit face each other cannot be detected.

SUMMARY

A printing apparatus according to the present disclosure to solve the above-described problem includes a support portion configured to support a medium, a printing unit configured to carry out printing onto the medium supported by the support portion, a support portion moving unit configured to move at least a part of the support portion in a facing direction, that is a direction in which the support portion and the printing unit face each other, to change a support position of the medium in the facing direction, at least one detected unit having position information in the facing direction, the detected unit being configured to move in the facing direction together with the support portion, a detector configured to detect the position information, and a control unit configured to detect a position of the support portion in the facing direction based on the position information detected by the detector.

DESCRIPTION OF EXEMPLARY EMBODIMENTS

Figure 1:
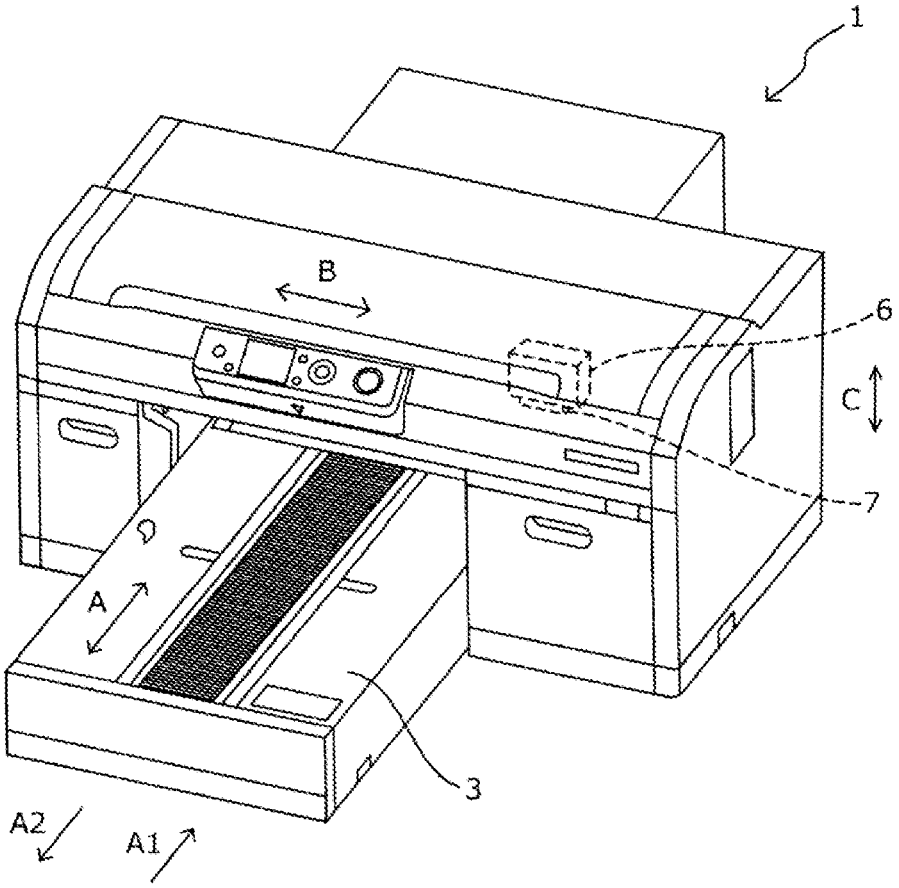
FIG. 1 is a schematic perspective view illustrating a printing apparatus according to an embodiment of the present disclosure.

First, the present disclosure will be schematically described.

A printing apparatus according to a first aspect of the present disclosure to solve the above-described problem includes a support portion configured to support a medium, a printing unit configured to carry out printing onto the medium supported by the support portion, a support portion moving unit configured to move at least a part of the support portion in a facing direction, that is a direction in which the support portion and the printing unit face each other, to change a support position of the medium in the facing direction, at least one detected unit having position information in the facing direction, the detected unit being configured to move in the facing direction together with the support portion, a detector configured to detect the position information, and a control unit configured to detect a position of the support portion in the facing direction, based on the position information detected by the detector.

According to this aspect, the printing apparatus includes the detected unit having position information in the facing direction, the detected unit being configured to move in the facing direction together with the support portion, the detector configured to detect the position information, and the control unit configured to detect a position of the support portion in the facing direction based on the position information detected by the detector. Thus, the position of the support portion in the facing direction can be detected in the printing apparatus.

In a printing apparatus according to a second aspect of the present disclosure, in the first aspect, the at least one detected unit has, as the position information, configurations different from each other depending on a position in the facing direction, and the detector is configured to detect the different configurations.

According to this aspect, the position information of the detected unit has a configuration different depending on the position in the facing direction, and the detector is configured to detect the different configuration. Thus, the detected unit can be simply configured, and the position of the support portion in the facing direction can be detected with the simple configuration.

In a printing apparatus according to a third aspect of the present disclosure, in the second aspect, each of the at least one different configuration is a configuration in which a pattern is formed depending on the position in the facing direction, and the detector is configured to detect the pattern.

According to this aspect, the different configuration is a configuration in which a pattern is formed depending on the position in the facing direction, and thus, the detected unit can be particularly simply configured, and the position of the support portion in the facing direction can be detected with a particularly simple configuration.

In a printing apparatus according to a fourth aspect of the present disclosure, in the third aspect, the detected unit includes a first detected unit formed with a first pattern as the pattern and a second detected unit formed with a second pattern as the pattern, the second pattern being different from the first pattern, and the control unit is configured to detect the position of the support portion in the facing direction based on a combination of a plurality of the patterns including the first pattern and the second pattern.

According to this aspect, the detected unit includes the first detected unit formed with the first pattern and the second detected unit formed with the second pattern, and the control unit is configured to detect the position of the support portion in the facing direction based on the combination of the plurality of patterns including the first pattern and the second pattern, and thus, each of the detected units can be simply configured and the position of the support portion in the facing direction can be detected with high accuracy based on detection results from the plurality of detected units.

In a printing apparatus according to a fifth aspect of the present disclosure, in any one of the first to fourth aspects, the support portion moving unit is configured to move the support portion in the facing direction by an operation involving contact by a user.

According to this aspect, the support portion moving unit is configured to move the support portion in the facing direction by an operation involving contact by a user, and thus, the support portion moving unit can be configured such that the user can easily and intuitively move the support portion in the facing direction.

In a printing apparatus according to a sixth aspect of the present disclosure, in the fifth aspect, the support portion is configured to move between a first position and a second position along a movement direction intersecting the facing direction, the first position is a position at which the medium is set on the support portion by a user, the second position is a start position of the support portion when printing onto the medium is started, and the detected unit is provided on a side of the second position from the support portion moving unit in the movement direction.

According to this aspect, the detected unit is provided on a side of the second position from the support portion moving unit in the movement direction. In other words, the detected unit is provided on the rear side from the support portion moving unit with respect to the position at which the medium is set on the support portion, and thus, a situation can be prevented in which the detected unit obstructs user operation when the user operates the support portion moving unit to move the support portion in the facing direction.

In a printing apparatus according to a seventh aspect of the present disclosure, in any one of the first to sixth aspects, the detector is configured to detect the position information without contacting the detected unit.

According to this aspect, the detector is configured to detect the position information without contacting the detected unit, and thus, abrasion of the detector and the detected unit caused by being brought in contact with each other can be prevented.

In a printing apparatus according to an eighth aspect of the present disclosure, in any one of the first to seventh aspects, the control unit is configured to transmit, to a display unit, the detected information of the position of the support portion in the facing direction.

According to this aspect, the detected information of the position of the support portion in the facing direction is transmitted to the display unit, and thus, a detection result of the position of the support portion in the facing direction can be notified to the user.

A method of detecting a position of a support portion according to a ninth aspect of the present disclosure is a method of detecting a position of a support portion in a printing apparatus including a support portion configured to support a medium, a printing unit configured to carry out printing onto the medium supported by the support portion, a support portion moving unit configured to move at least a part of the support portion in a facing direction, that is a direction in which the support portion and the printing unit face each other, to change a support position of the medium in the facing direction, at least one detected unit having position information in the facing direction, the detected unit being configured to move in the facing direction together with the support portion, and a detector configured to detect the position information, and the method includes detecting a position of the support portion in the facing direction, based on the position information detected by the detector.

According to this aspect, in the printing apparatus including the detected unit having position information in the facing direction, the detected unit being configured to move in the facing direction together with the support portion, and the detector configured to detect the position information, the position of the support portion in the facing direction is detected based on the position information detected by the detector. Thus, the position of the support portion in the facing direction can be detected in the printing apparatus.

Hereinafter, a printing apparatus 1 according to an embodiment of the disclosure will be described in detail with reference to the appended drawings.

Figure 2:
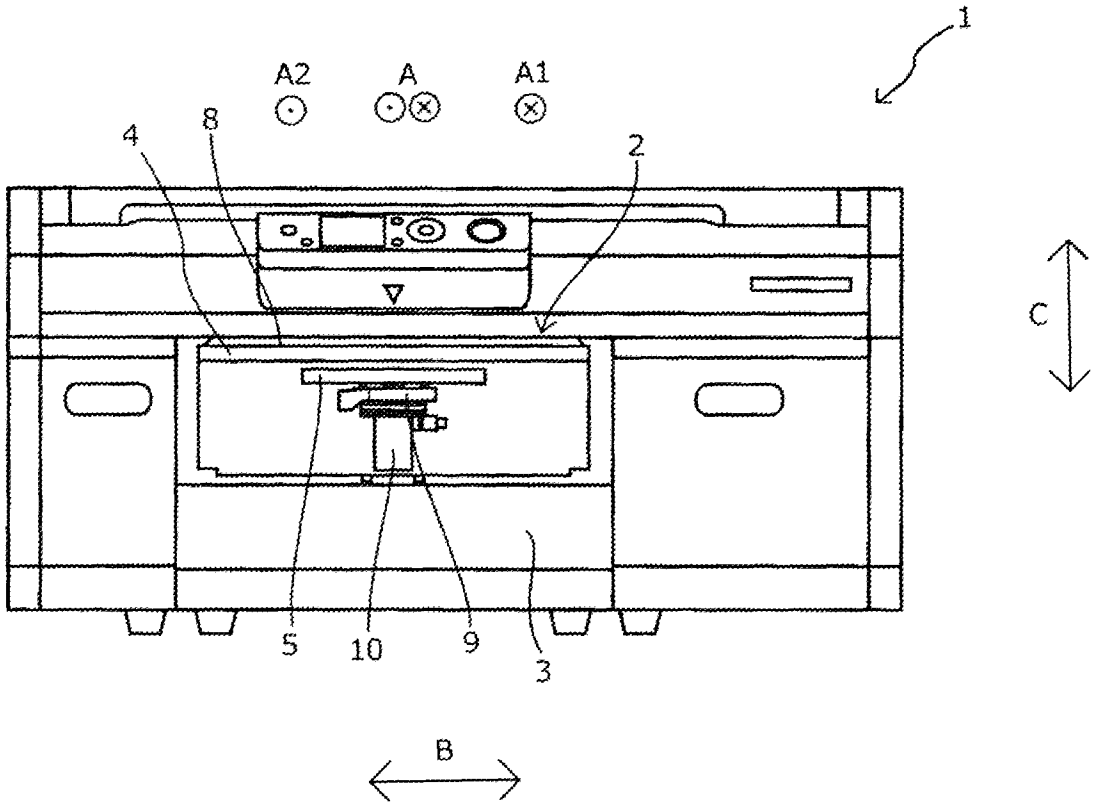
FIG. 2 is a schematic front view illustrating the printing apparatus according to the embodiment of the present disclosure.
Figure 3:
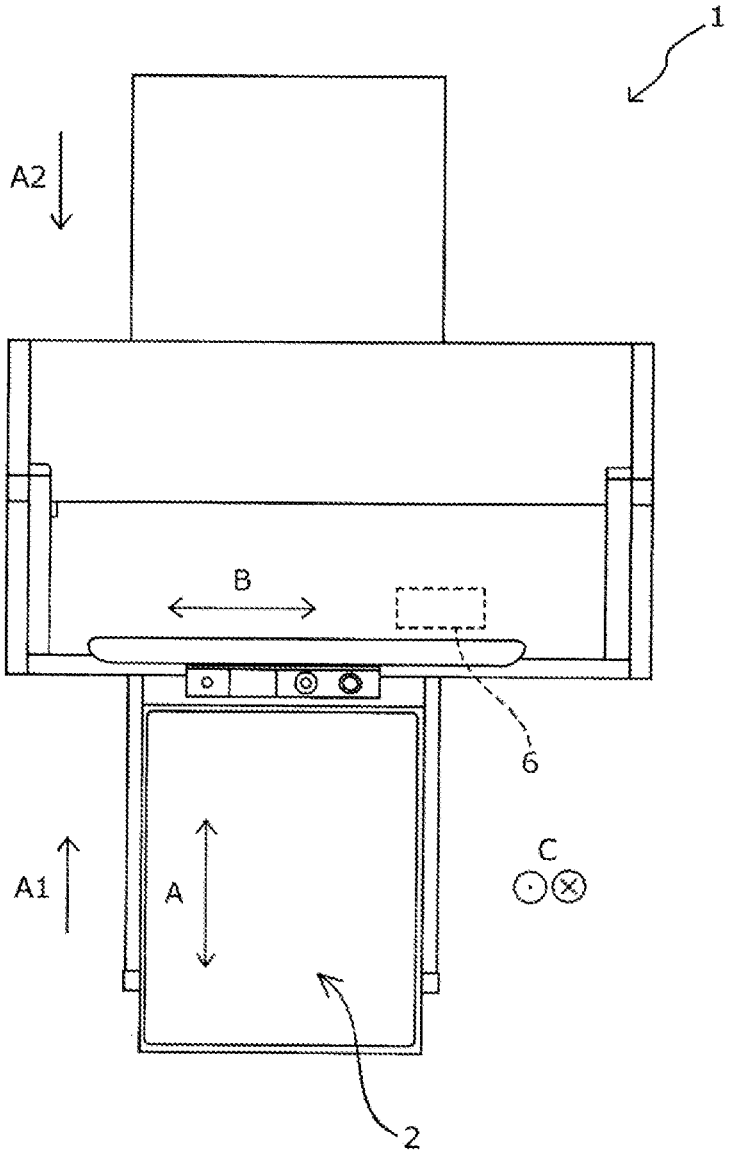
FIG. 3 is a schematic plan view illustrating the printing apparatus according to the embodiment of the present disclosure.

First, an overview of the printing apparatus 1 according to the embodiment will be described with mainly reference to FIG. 1 to FIG. 3. FIG. 1 is a schematic perspective view of the printing apparatus 1, FIG. 2 is a schematic front view of the printing apparatus 1, and FIG. 3 is a schematic plan view of the printing apparatus. Note that each of FIG. 1 to FIG. 3 illustrates a state with some component members simplified.

Specifically, the printing apparatus 1 according to the embodiment is an inkjet printer. The printing apparatus 1 includes a medium supporting unit 2 serving as a support portion configured to move in a movement direction A while supporting a medium. The medium supporting unit 2 includes a tray 4 configured to support the medium on a support face 8. The printing apparatus 1 includes a medium transporting unit 3 configured to transport the medium supported by the tray 4 in the movement direction A. The movement direction A is a direction including a direction A1 and a direction A2 opposite from the direction A1. In addition, the tray 4 is detachably mounted on a stage 5, which functions as a base unit. Here, an attachment/detachment direction of the tray 4 to/from the stage 5 corresponds to a vertical direction for the printing apparatus 1 according to the embodiment. A lever 9 is a component for adjusting the height of the tray 4, that is, the distance of the tray 4 from a printing head 7.

Figure 7:
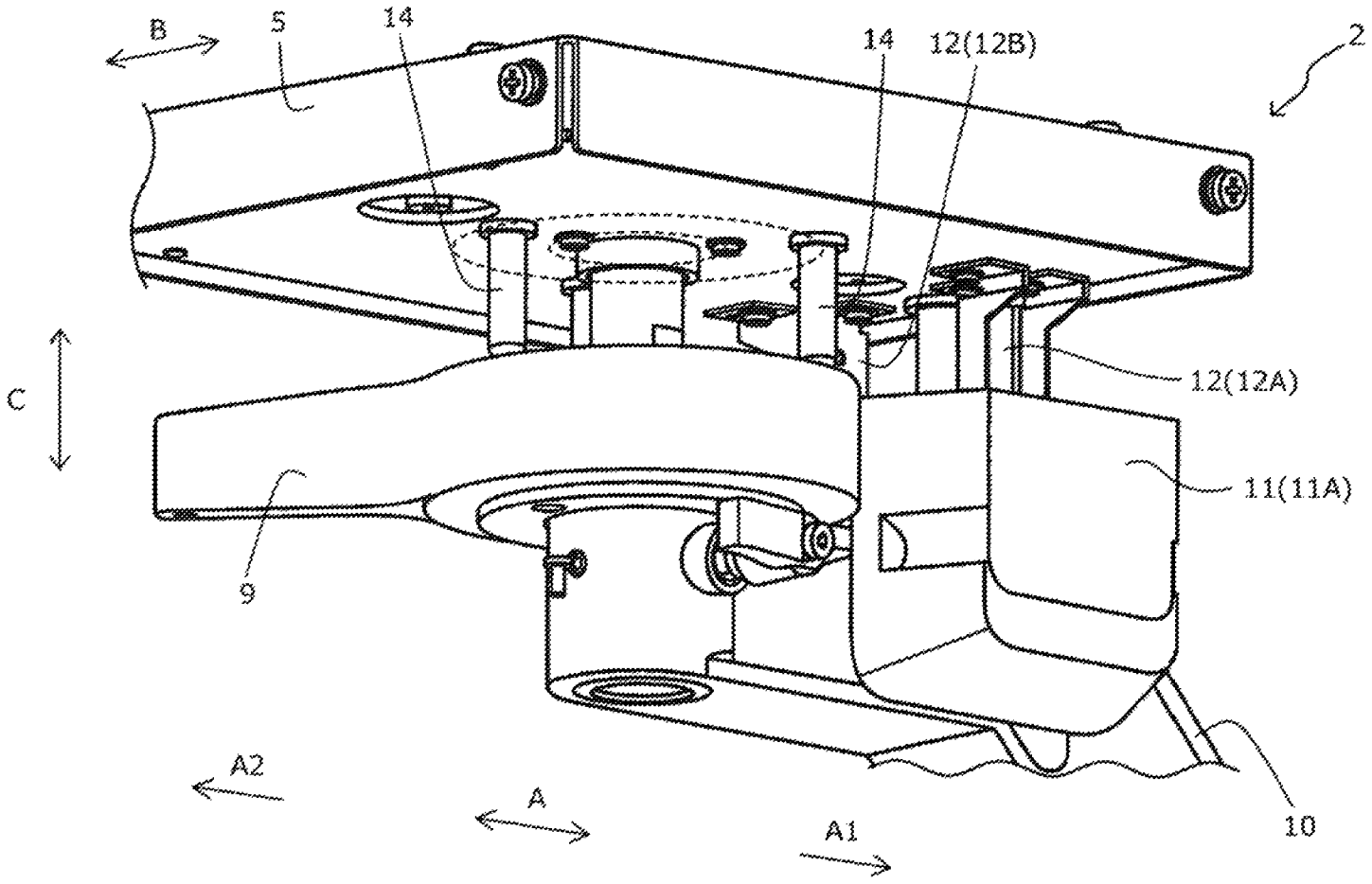
FIG. 7 is a schematic perspective view illustrating the periphery of the detector and the detected unit of the printing apparatus according to the embodiment of the present disclosure, viewed from an angle different from that of FIG. 6.
Figure 8:
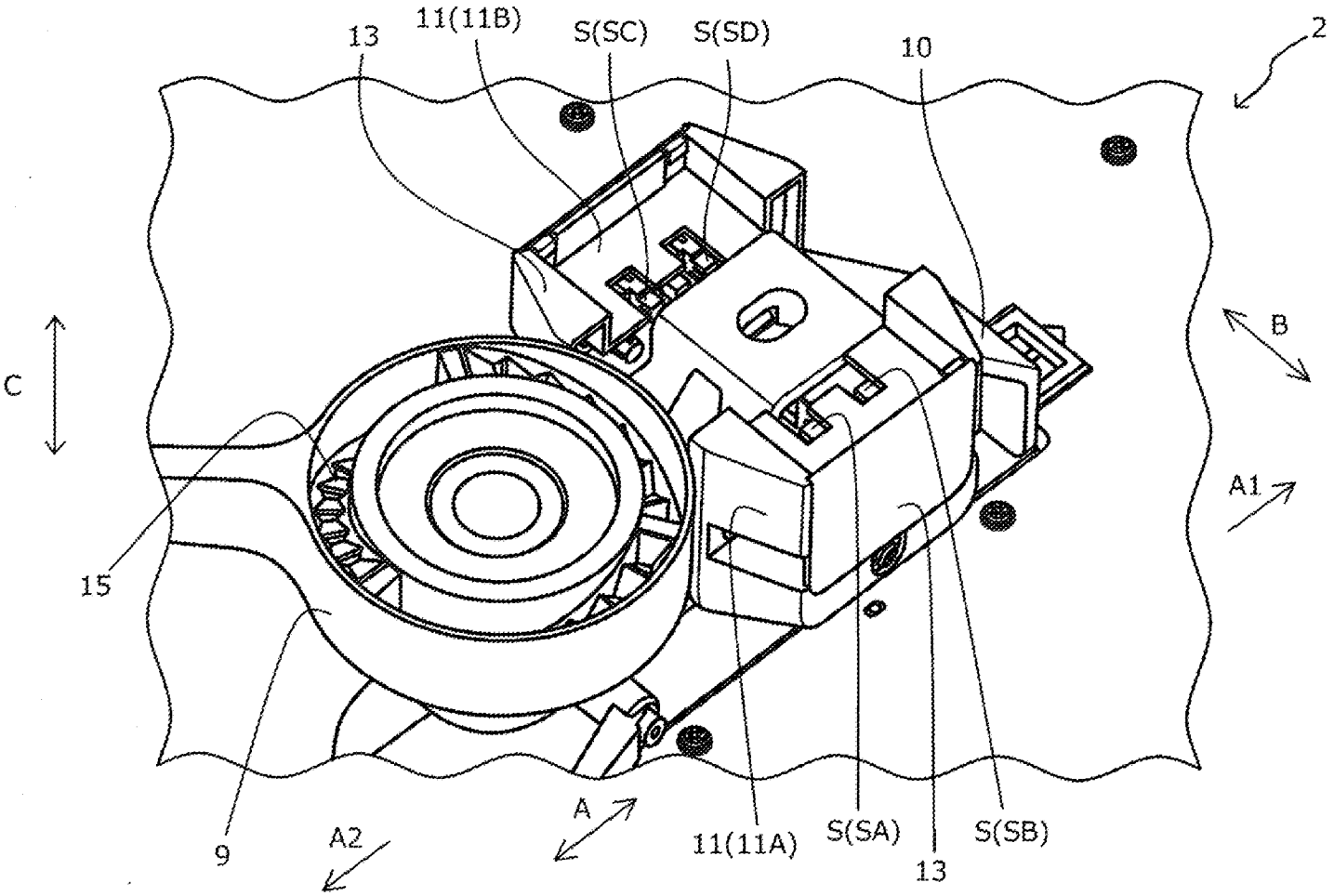
FIG. 8 is a schematic perspective view illustrating the periphery of the detector of the printing apparatus according to the embodiment of the present disclosure.

The stage 5 includes a protrusion portion 14 extending downward in the vertical direction, as illustrated in FIG. 7 and the like. In addition, a mounting part 15 having a step-like shape, which is illustrated in FIG. 8, is formed inside the lever 9. The mounting part 15 is a portion at which the protrusion portion 14 of the stage 5 is mounted. In other words, the lever 9 supports the stage 5 by supporting the protrusion portion 14 on the mounting part 15. Furthermore, rotating the lever 9 changes a position in the mounting part 15 at which the protrusion portion 14 is mounted, and then the tray 4 moves in a direction along a facing direction C together with the stage 5. The facing direction C is a direction in which the medium supporting unit 2 and the printing head 7, which will be described later, face each other. In the embodiment, the facing direction C is a direction along the vertical direction. Note that in the embodiment, the lever 9 is manually operated by a user. Alternately stated, the medium supporting unit 2 according to the embodiment is configured to change a support position of the medium in the facing direction C by an operation involving contact by a user. Note that as illustrated in FIG. 2, the lever 9 is provided on an arm portion 10 of the medium supporting unit 2. A variety of materials can be used as the medium, including textiles such as fabric and cloth, paper, vinyl chloride resin, and the like.

As described above, the lever 9 is configured to move a part of the medium supporting unit 2 serving as the support portion to change the support position of the medium in the facing direction C. Therefore, the lever 9 can be considered as a support portion moving unit. In the embodiment, the lever 9 serving as the support portion moving unit is configured to move the tray 4 and the stage 5 that are part of the medium supporting unit 2. However, the support portion moving unit is not limited to such a configuration. The support portion moving unit may be configured to move the entire medium supporting unit 2 or may be configured to move only the tray 4. In other words, the support portion moving unit may be configured to move at least a part of the support portion.

In addition, the printing apparatus 1 includes, in its interior, the printing head 7 serving as a printing unit configured to eject ink being an example of liquid to form an image onto a medium. "Form an image onto a medium" means, in other words, "print an image onto a medium". Note that an ejecting direction being a direction in which ink is ejected from the printing head 7 is a direction along the vertical direction in the embodiment. The ink is supplied to the printing head 7 from a plurality of ink cartridges provided for each color. The printing apparatus 1 according to the embodiment is configured to reciprocate a carriage 6 provided with the printing head 7 in a width direction B intersecting the movement direction A. The printing apparatus 1 reciprocates the printing head 7 in the width direction B and causes the printing head 7 to eject ink onto a medium supported by the tray 4 to form a desired image.

Note that in the printing apparatus 1 according to the embodiment, a front side in the lower left direction in FIG. 1 is a set position in which a medium is set in the tray 4. The tray 4 on which a medium is set is moved in the direction A1 of the movement direction A until the tray 4 reaches a printing start position on the rear side in the upper right direction in FIG. 1. The printing is then carried out while the tray 4 is moved in the direction A2 of the movement direction A. The printing start position denotes a start position of the medium supporting unit 2 when printing onto a medium starts. The set position denotes a stop position of the medium supporting unit 2 when the medium is to be set to the medium supporting unit 2. Note that in the printing apparatus 1, a medium may be set on the tray 4 with the tray 4 being removed from the stage 5, and the tray 4 on which the medium is set may be attached to the stage 5. In this case, a position at which the tray 4 on which the medium is set is attached to the stage 5 corresponds to the set position. That is, the "set position" is a position at which a medium is directly or indirectly mounted on a mobile body configured to move in the movement direction A. In addition, the set position and the printing start position indicate two positions in the movement direction A, and thus, the set position may be also called a "first position" and the printing start position may be also called a "second position". Thus, it may be said that the medium supporting unit 2 is configured to move between the first position and the second position along the movement direction A.

Although the printing apparatus 1 according to the embodiment includes the printing head 7 configured to print an image while the printing head 7 reciprocates in the width direction B, the printing apparatus 1 may include what is known as a line head in which a plurality of nozzles ejecting ink are provided in an intersecting direction intersecting the movement direction of the medium.

Here, the "line head" is a printing head provided such that a region including the nozzles formed in the intersecting direction intersecting the movement direction of a medium can cover the entire intersecting direction, and is used in a printing apparatus for forming an image by relatively moving the printing head or the medium. Note that in the line head, the region including the nozzles in the intersecting direction may not be configured to cover the intersecting direction for all types of media that can be used in the printing apparatus.

In addition, the printing head 7 according to the embodiment is a printing unit configured to print an image by ejecting ink onto the medium. However, the printing unit is not limited to such a printing unit, and a transfer type printing unit configured to transfer a color material onto a medium to carry out printing may be used.

Figure 4:
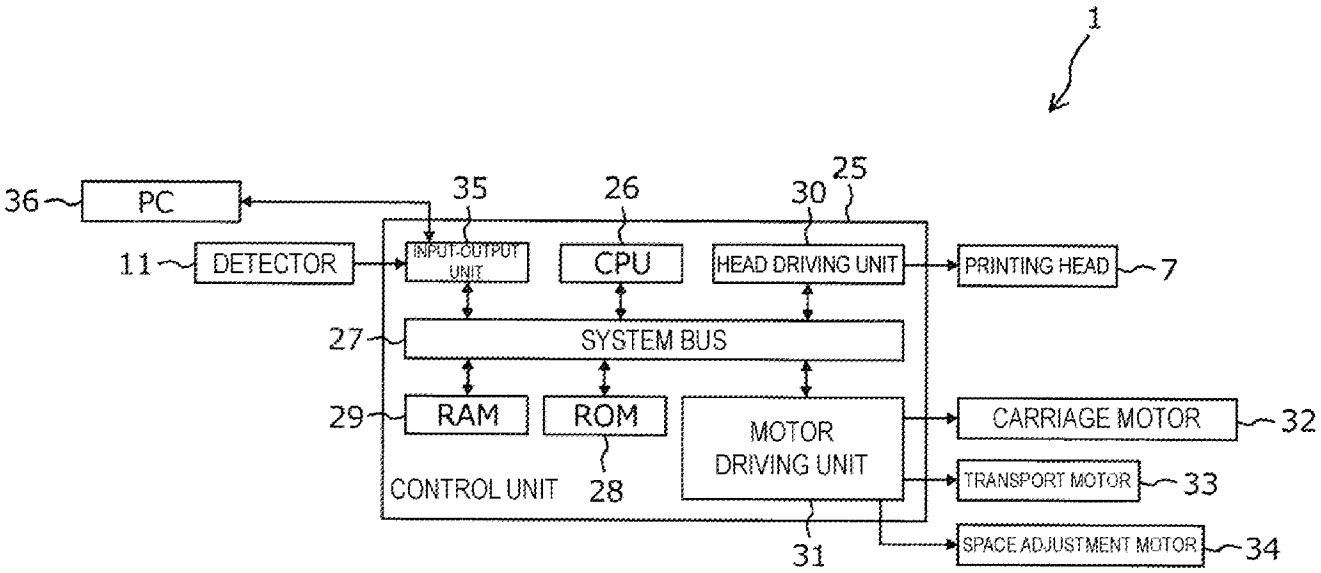
FIG. 4 is a block diagram of the printing apparatus according to the embodiment of the present disclosure.

Next, an electrical configuration of the printing apparatus 1 according to the embodiment will be described with reference to FIG. 4. FIG. 4 is a block diagram of the printing apparatus 1.

The printing apparatus 1 includes a control unit 25 configured to control various operations. The control unit 25 is provided with a CPU 26 configured to manage control of the entire printing apparatus 1. The CPU 26 is coupled through a system bus 27 to a ROM 28 configured to store various types of control programs to be implemented by the CPU 26, and a RAM 29 configured to temporarily store data.

In addition, the CPU 26 is coupled through the system bus 27 to a head driving unit 30 configured to drive the printing head 7.

The CPU 26 is also coupled through the system bus 27 to a motor driving unit 31. The motor driving unit 31 is coupled to a carriage motor 32 configured to move the carriage 6 provided with the printing head 7 in the width direction B, a transport motor 33 configured to transport a medium, that is, to move the tray 4 in the movement direction A, and a space adjustment motor 34 configured to move the printing head 7 along the facing direction C to adjust a space between the printing head 7 and the medium.

Furthermore, the CPU 26 is coupled through the system bus 27 to an input-output unit 35. The input-output unit 35 is coupled to a detector 11 and a PC 36. Note that the detector 11 will be described in detail later.

The control unit 25 according to the embodiment is configured as described above, and thus, can control the driving of component members such as the printing head 7, the carriage 6, and the tray 4 associated with a printing operation, and can determine, based on a detection result from the detector 11, a position of the stage 5 in the facing direction C. Furthermore, the control unit 25 according to the embodiment is configured to cause each of the component members to execute a corresponding operation such as adjusting a space between the printing head 7 and the medium, adjusting an ejection timing of ink from the printing head 7, based on the determination result.

Next, the medium supporting unit 2, the detector 11, and a detected unit 12 that are main parts of the printing apparatus 1 according to the embodiment will be described with reference to FIG. 5 to FIG. 14.

Figure 5:
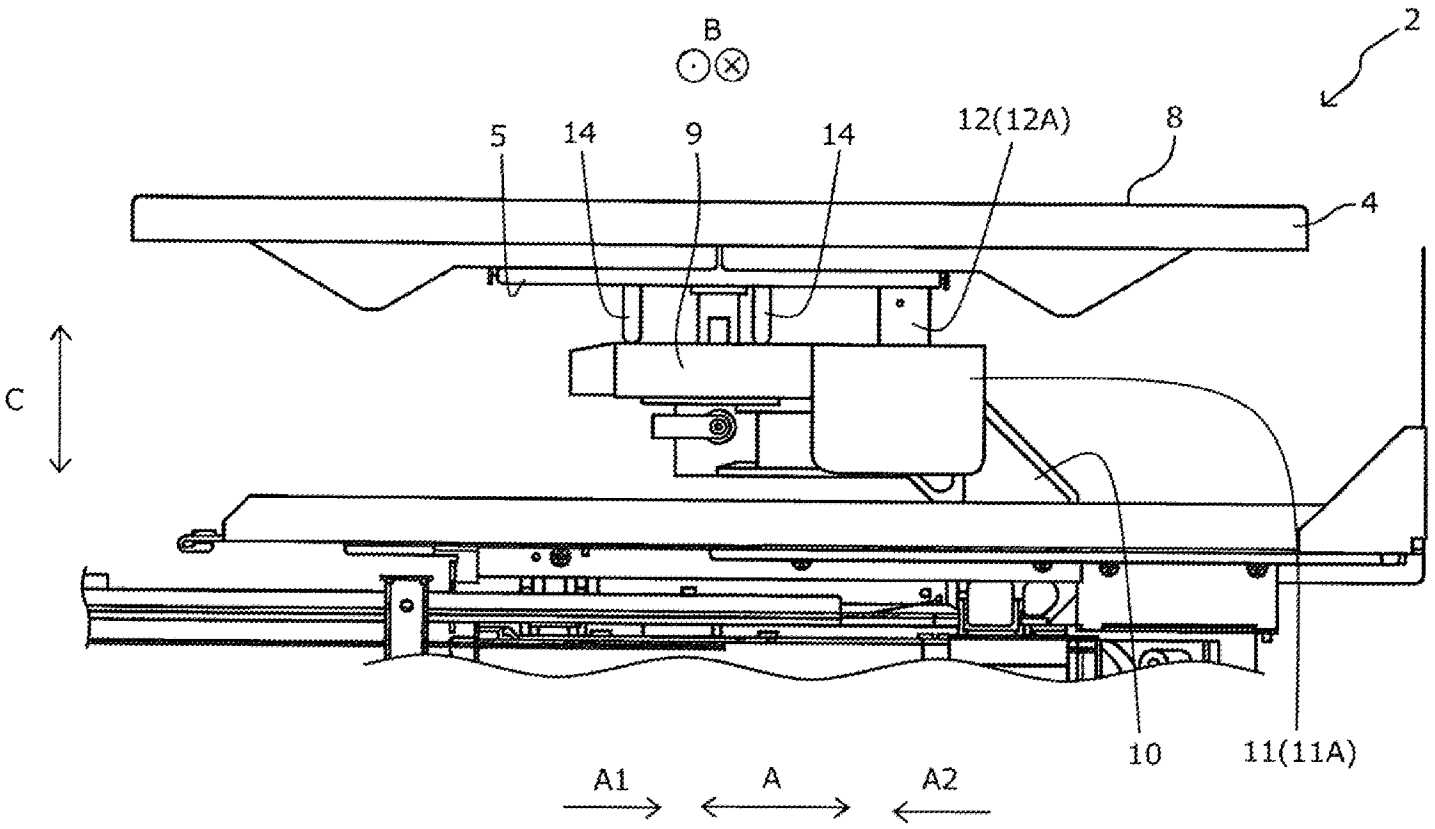
FIG. 5 is a schematic side view illustrating a support portion of the printing apparatus according to the embodiment of the present disclosure.

FIG. 5 is a schematic side view of the medium supporting unit 2 serving as the support portion. As illustrated in FIG. 5, the printing apparatus 1 includes the detector 11 configured to detect an object located in a detection range, and the detected unit 12 provided to be located in the detection range of the detector 11. In the embodiment, the detector 11 and the detected unit 12 are each attached to the medium supporting unit 2.

Figure 6:
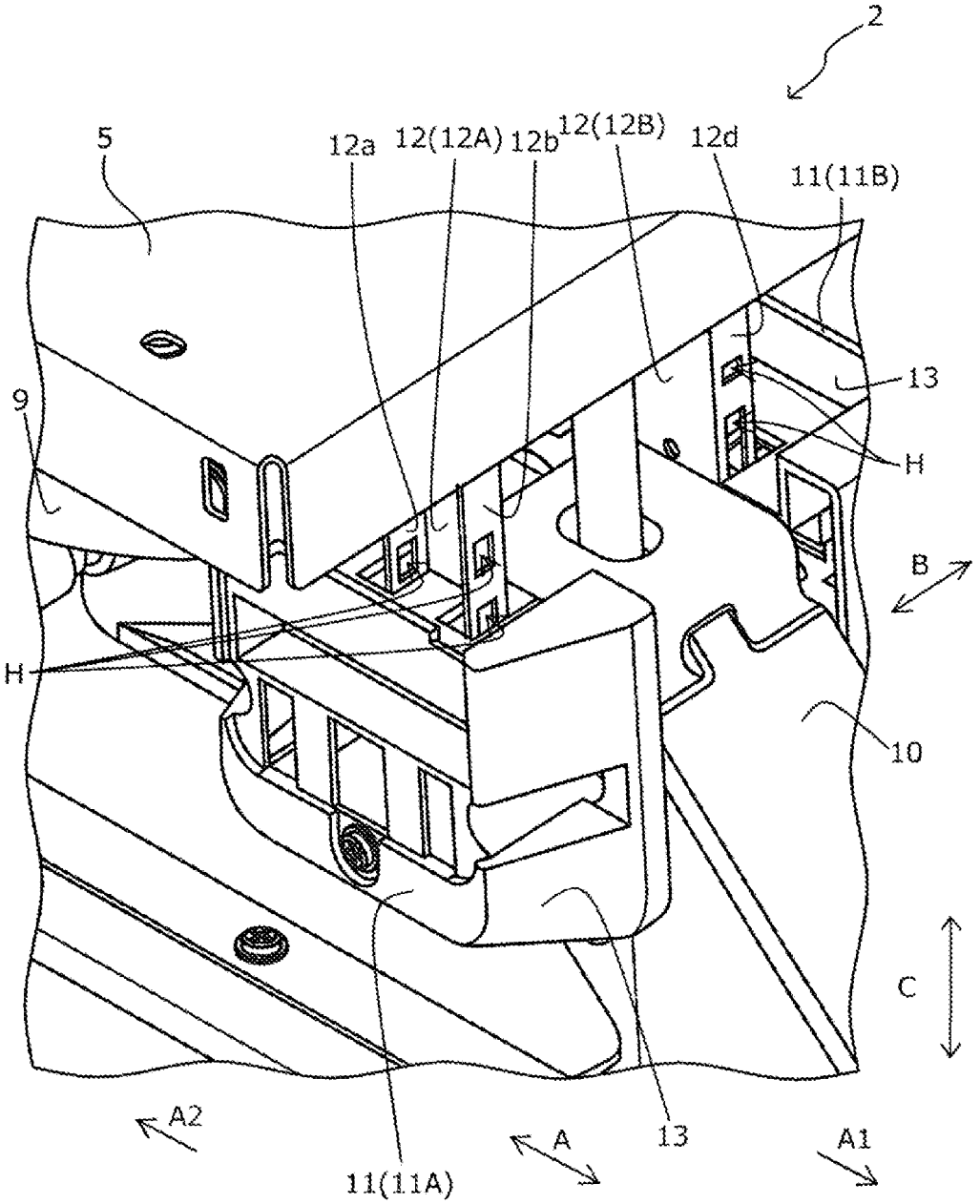
FIG. 6 is a schematic perspective view illustrating a periphery of a detector and a detected unit of the printing apparatus according to the embodiment of the present disclosure.

FIG. 6 and FIG. 7 are schematic perspective views illustrating a periphery of the detector 11 and the detected unit 12. Note that FIG. 6 and FIG. 7 are views taken from different angles from each other. FIG. 8 is a schematic perspective view illustrating a periphery of the detector 11. As illustrated in FIG. 6 and FIG. 8, the detector 11 according to the embodiment includes a detector 11A and a detector 11B. In other words, the detector 11 is provided on one side and the other side respectively of the center of the medium supporting unit 2 in the width direction B. In addition, as illustrated in FIG. 6, FIG. 7, and the like, the detected unit 12 according to the embodiment includes a detected unit 12A provided at a position corresponding to the detector 11A, and a detected unit 12B provided at a position corresponding to the detector 11B. In other words, as with the detector 11, the detected unit 12 is provided on one side and the other side respectively of the center of the medium supporting unit 2 in the width direction B.

In addition, as illustrated in FIG. 6, FIG. 7, and FIG. 8, the detector 11 according to the embodiment is provided on the arm portion 10 of the medium supporting unit 2. As illustrated in FIG. 8 and the like, in the detector 11 according to the embodiment, both the detector 11A and the detector 11B include a light sensor S and a holder 13 configured to hold the light sensor S. The detector 11A includes a light sensor SA and a light sensor SB as the light sensor S, and the detector 11B includes a light sensor SC and a light sensor SD as the light sensor S.

Figure 9:
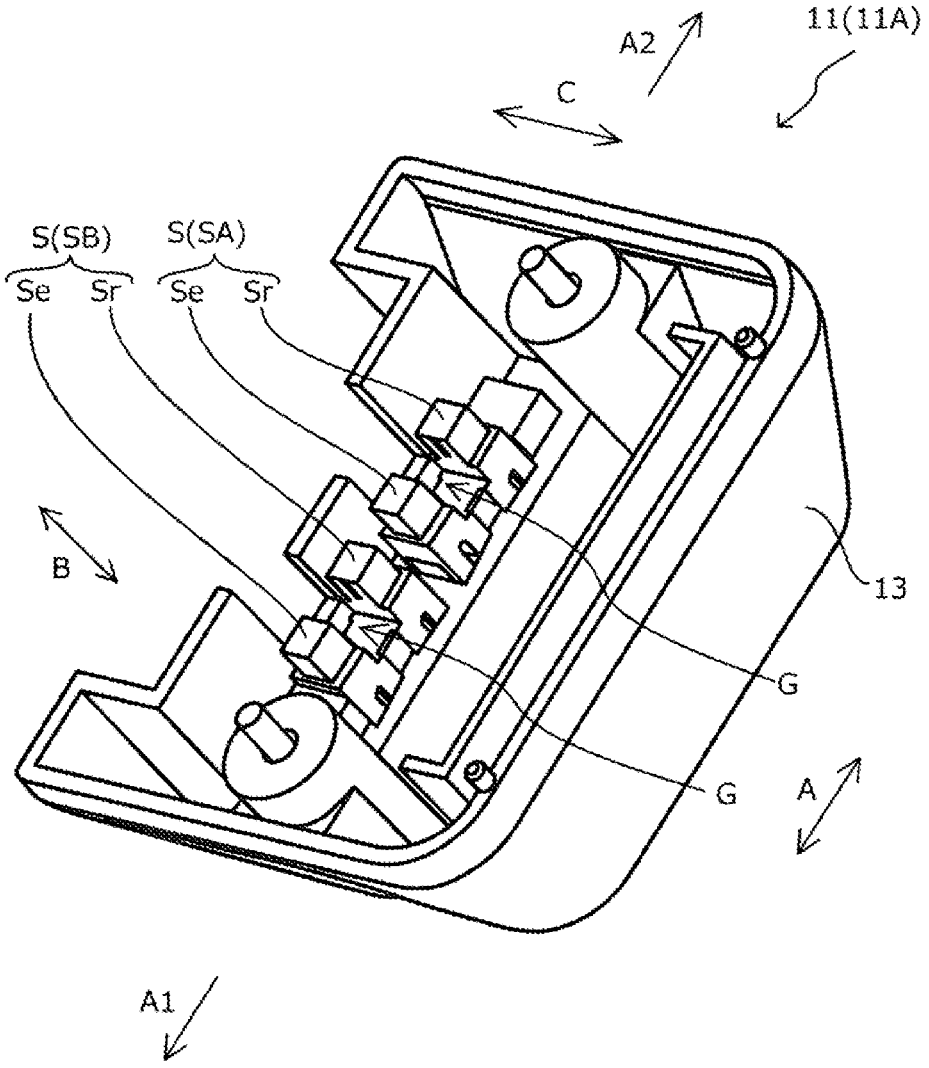
FIG. 9 is a schematic perspective view illustrating the detector of the printing apparatus according to the embodiment of the present disclosure.

FIG. 9 is a schematic perspective view of the detector 11. As illustrated in FIG. 9, each of the light sensors S includes a light-emitting unit Se and a light-receiving unit Sr. Although the detector 11A is illustrated as an example in FIG. 9, the detector 11B has the same configuration. The light-emitting unit Se is configured to emit light toward the light-receiving unit Sr. The light-receiving unit Sr is configured to receive light emitted from the light-emitting unit Se. Furthermore, each of the light sensors S is configured to detect whether or not light emitted from the light-emitting unit Se toward the light-receiving unit Sr in a gap G between the light-emitting unit Se and the light-receiving unit Sr is blocked by the detected unit 12.

Figure 10:
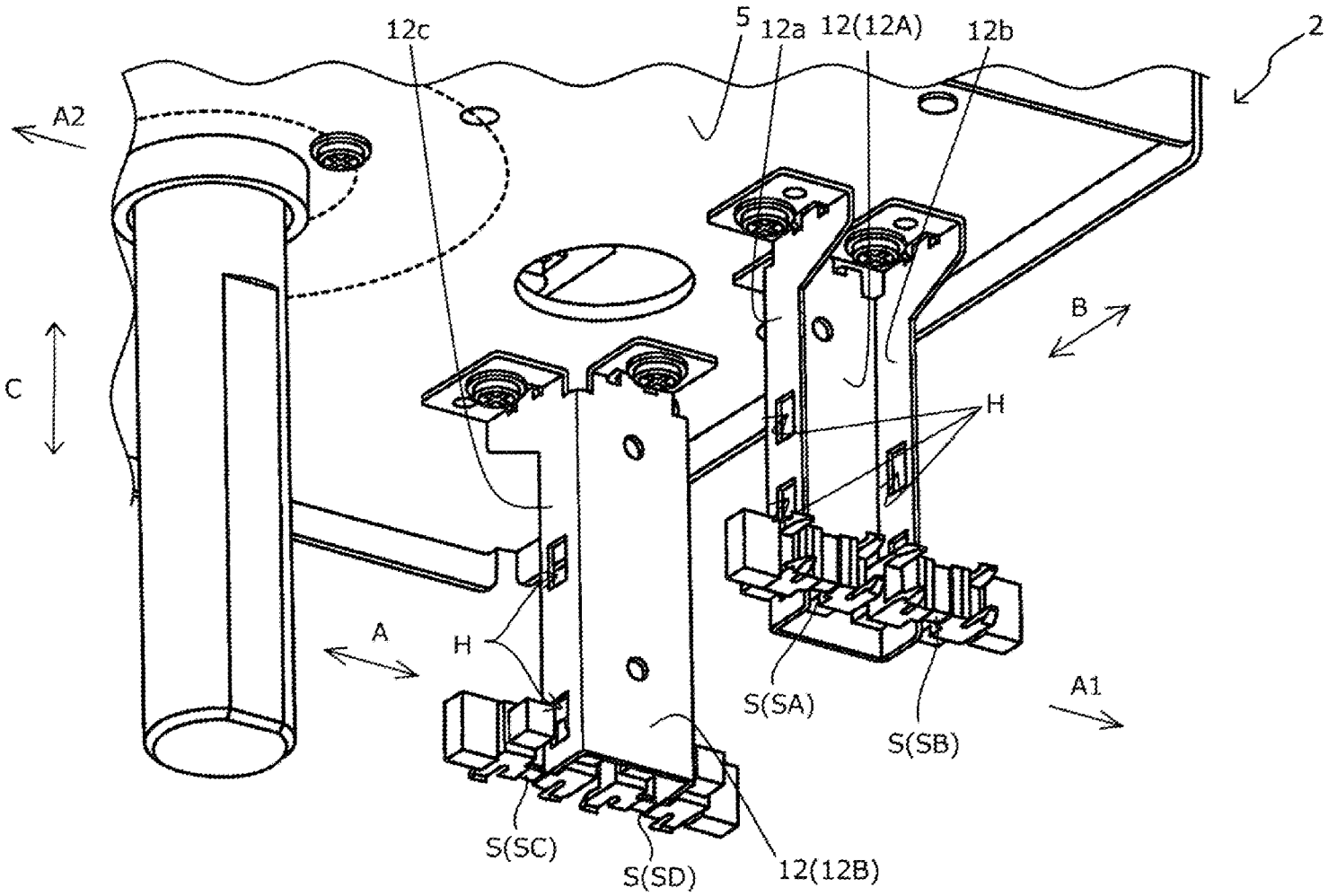
FIG. 10 is a schematic perspective view illustrating the periphery of the detected unit of the printing apparatus according to the embodiment of the present disclosure.

FIG. 10 is a schematic perspective view illustrating a periphery of the detected unit 12. As illustrated in FIG. 10, the detected unit 12 according to the embodiment is provided on the stage 5 of the medium supporting unit 2. Specifically, the detected unit 12 is attached, on the stage 5, to a surface opposite to the surface on which the tray 4 is mounted. Thus, the detected unit 12 is configured to be moved in the facing direction C together with the stage 5 by a user using the lever 9. In other words, the detected unit 12 moves in the facing direction C together with the medium supporting unit 2 in conjunction with the medium supporting unit 2 being moved in the facing direction C by the lever 9.

Here, the detected unit 12 is configured to indicate a position thereof in the facing direction C. In other words, the detected unit 12 has position information thereof in the facing direction C. The detected unit 12 has a different configuration in the facing direction C to represent the position information thereof. The "different configuration in the facing direction C" specifically corresponds to a pattern corresponding to a position in the facing direction C represented by the presence or absence of a hole portion H. Details will be described below.

Figure 11:
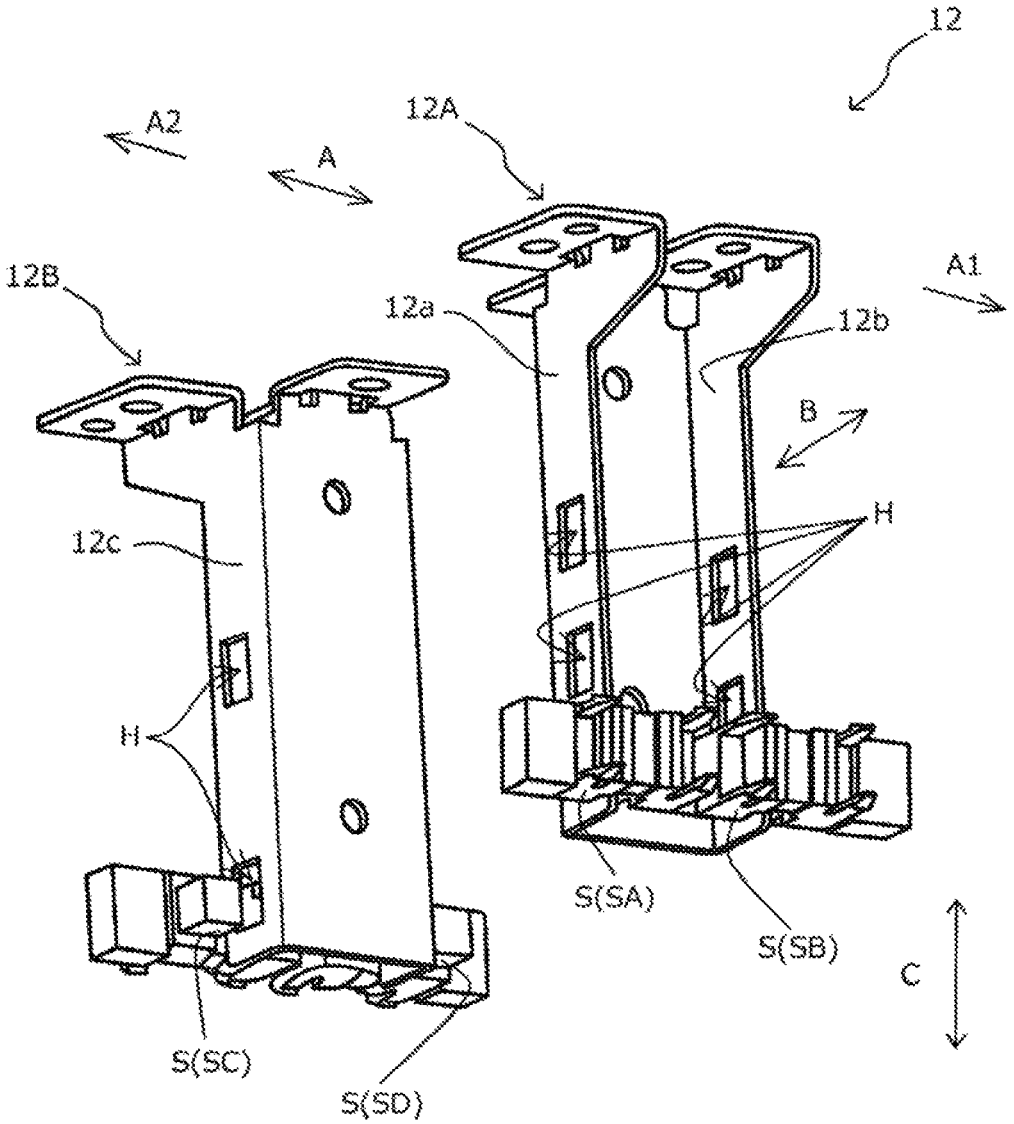
FIG. 11 is a schematic perspective view illustrating the detected unit of the printing apparatus according to the embodiment of the present disclosure.
Figure 12:
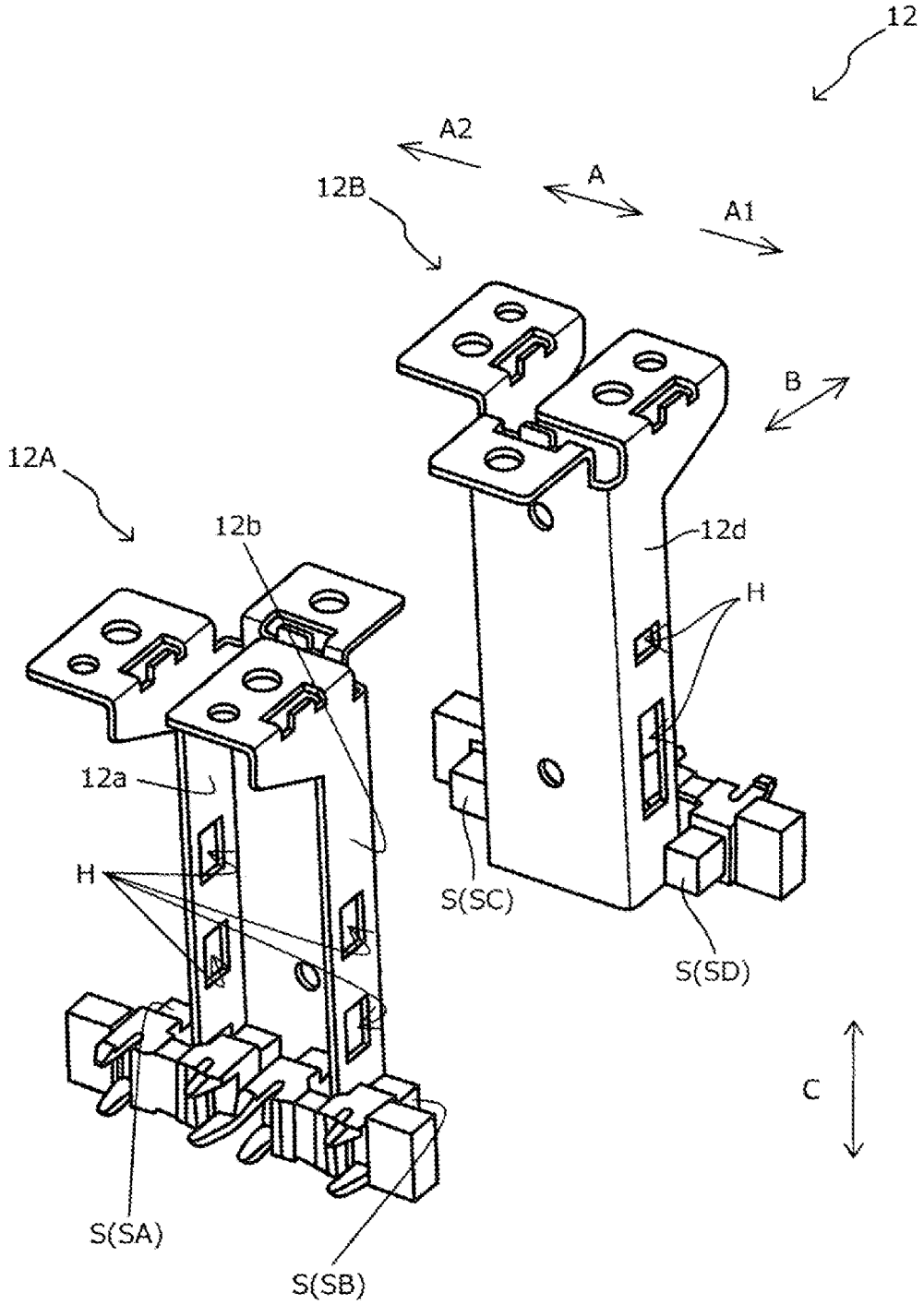
FIG. 12 is a schematic perspective view illustrating the detected unit of the printing apparatus according to the embodiment of the present disclosure, viewed from an angle different from that of FIG. 11.

FIG. 11 and FIG. 12 are schematic perspective views of the detected unit 12. Note that FIG. 11 and FIG. 12 are views taken from different angles from each other. As illustrated in FIG. 10, FIG. 11, FIG. 12, and the like, in the detected unit 12 according to the embodiment, both the detected unit 12A and the detected unit 12B have a substantially U-shape, that is, a substantially C-shape when viewed from the facing direction C. The detected unit 12A includes a flat portion 12*a* that is provided at a position corresponding to a gap G of the light sensor SA and that is formed with a plurality of the hole portions H, and a flat portion 12*b* that is provided at a position corresponding to a gap G of the light sensor SB and that is formed with a plurality of the hole portions H. The detected unit 12B includes a flat portion 12*c* that is provided at a position corresponding to a gap G of the light sensor SC and that is formed with a plurality of the hole portions H, and a flat portion 12*d* that is provided at a position corresponding to a gap G of the light sensor SD and that is formed with a plurality of the hole portions H. Here, a region corresponding to the hole portions H in the flat portion 12*a* to the flat portion 12*d* corresponds to a region of transmitting light emitted from the light-emitting unit Se toward the light-receiving unit Sr, and a region not provided with the hole portions H in the flat portion 12*a* to the flat portion 12*d* corresponds to a region of blocking light emitted from the light-emitting unit Se toward the light-receiving unit Sr. Thus, the detected unit 12 is configured to indicate the position thereof in the facing direction C by the presence or absence of the hole portion H.

Figure 13:
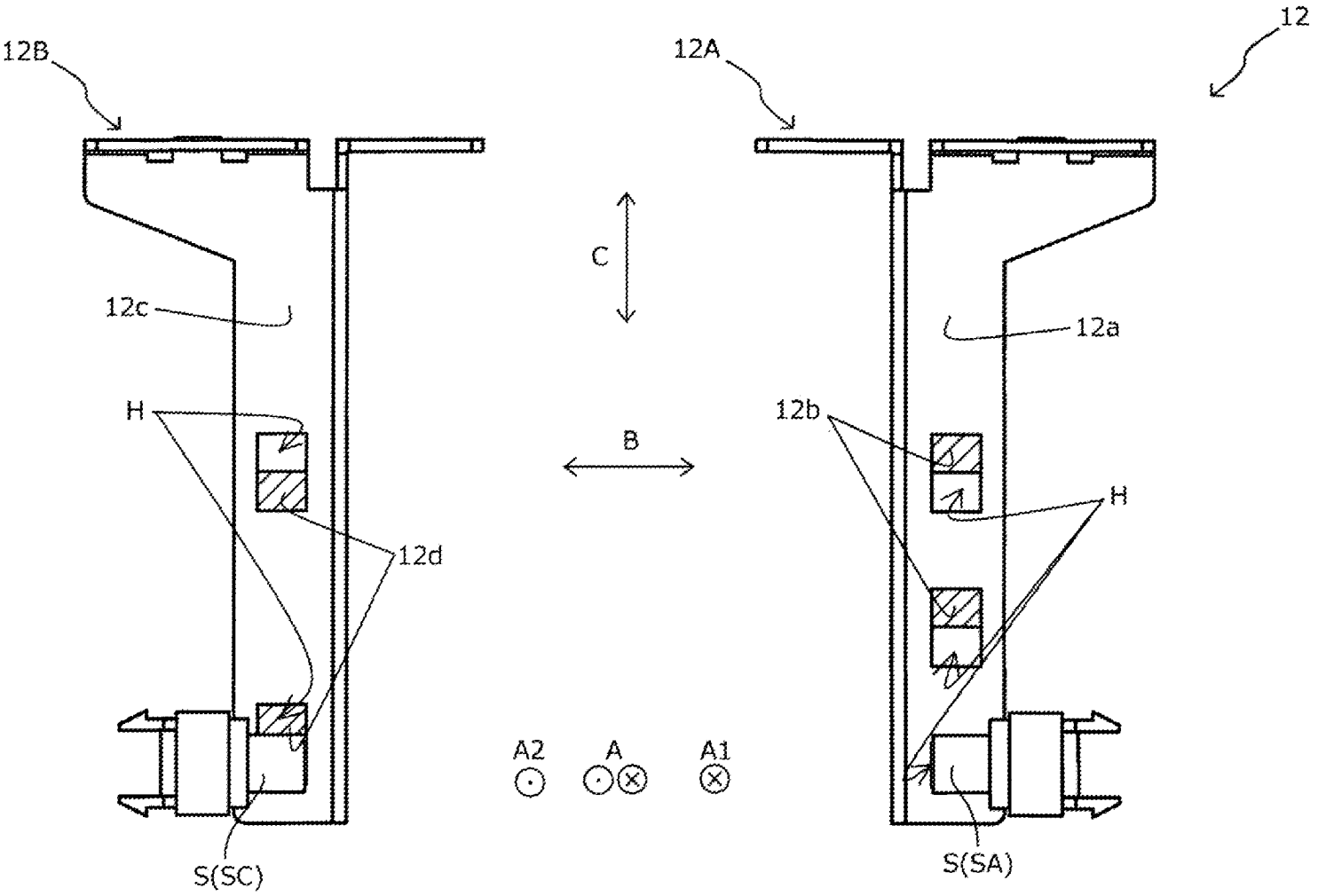
FIG. 13 is a schematic front view illustrating the detected unit of the printing apparatus according to the embodiment of the present disclosure.
Figure 14:
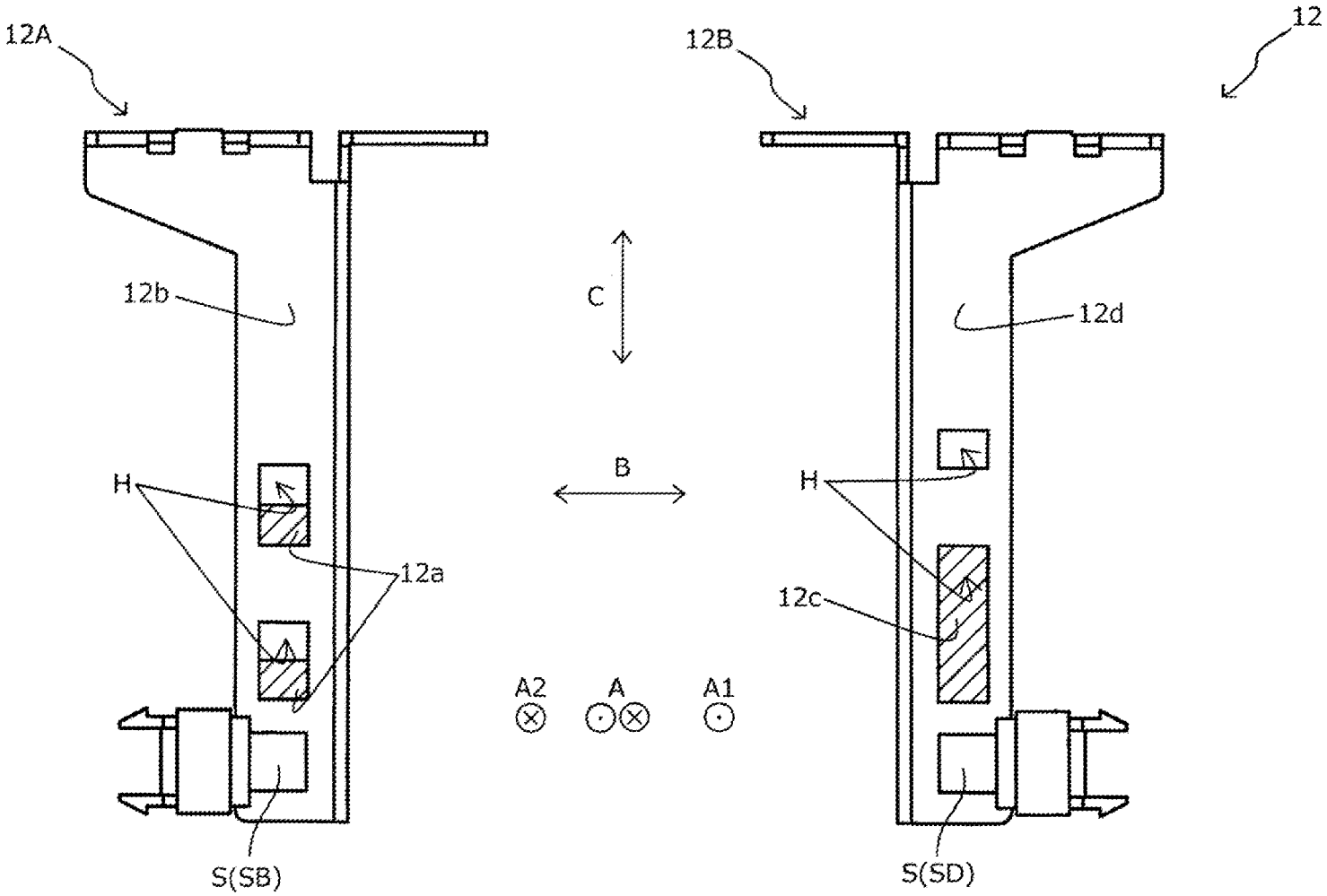
FIG. 14 is a schematic back view illustrating the detected unit of the printing apparatus according to the embodiment of the present disclosure.

FIG. 13 is a schematic front view of the detected unit 12 and FIG. 14 is a schematic back view of the detected unit 12. As illustrated in FIG. 13 and FIG. 14, a position of the hole portion H provided in the flat portion 12*a*, a position of the hole portion H provided in the flat portion 12*b*, a position of the hole portion H provided in the flat portion 12*c*, and a position of the hole portion H provided in the flat portion 12*d* are deviated from each other in the facing direction C. In other words, in each of the flat portions, the hole portion H is formed at a position deviated from each other in the facing direction C. That is, in each of the flat portions, a predetermined pattern represented by the presence or absence of the hole portion H is formed. Therefore, it may be said that a pattern corresponding to the position in the facing direction C is formed in each of the flat portions. The pattern is different for each of the flat portions. Thus, when the position of the detected unit 12 provided on the stage 5 is deviated in the facing direction C with respect to the detector 11 provided on the arm portion 10, the number of light sensors S in which light emitted from the light-emitting unit Se toward the light-receiving unit Sr is blocked and positions of the light sensors change. The control unit 25 is configured to determine the position of the stage 5 in the facing direction C, based on the number of light sensors S in which light is blocked and the positions of the light sensors S. In other words, the control unit 25 is configured to detect the position of the medium supporting unit 2 in the facing direction C, based on a combination of four patterns formed on each of the flat portions.

Here, the patterns formed on the four flat portions are defined as a first pattern, a second pattern, a third pattern, and a fourth pattern. At this time, the detected unit 12 according to the embodiment is considered to have a configuration including the detected unit 12A serving as a first detected unit formed with a first pattern, the detected unit 12B serving as a second detected unit formed with a second pattern, the flat portion 12*c* serving as a third detected unit formed with a third pattern, and the flat portion 12*d* serving as a fourth detected unit formed with a fourth pattern. Then, the control unit 25 detects the position of the medium supporting unit 2 in the facing direction C, based on the position information detected by the detector 11.

Here, an operation of detecting the position of the medium supporting unit 2 in the facing direction C will be specifically described below. In the printing apparatus 1 according to the embodiment, the height of the stage 5 is configured to be changed into nine stages by using the lever 9. In other words, the medium supporting unit 2 is configured to change the support position of the medium in the facing direction C into nine stages. That is, the mounting part 15 formed in the lever 9 has a step-like shape having nine stages. However, the number of stages for changing the support position of the medium may be eight or less, or may be ten or greater.

First, the user operates the lever 9 to adjust the position of the medium supporting unit 2 in the facing direction C to a desired stage. Then, the detector 11 detects the position information of the detected unit 12. The control unit 25 detects the position of the medium supporting unit 2 in the facing direction C, based on the detection result from the detector 11. Specifically, the control unit 25 detects the position of the medium supporting unit 2 as follows.

The control unit 25 determines that the stage 5 is at the highest stage, when the detection results from the light sensors S indicate "transmitted", "blocked", "transmitted", and "blocked" in an order of the light sensor SA, the light sensor SB, the light sensor SC, and the light sensor SD. In other words, in such a case, the support position of the medium in the facing direction C in the medium supporting unit 2 is determined to be at the closest to the printing head 7. Note that FIG. 13 and FIG. 14 represent this state. In addition, the control unit 25 determines that the stage 5 is at the second stage from the top, when the detection results from the light sensors S indicate "blocked", "blocked", "transmitted", and "blocked" in the order of the light sensor SA, the light sensor SB, the light sensor SC, and the light sensor SD. In addition, the control unit 25 determines that the stage 5 is at the third stage from the top, when the detection results from the light sensors S indicate "blocked", "transmitted", "blocked", and "transmitted" in the order of the light sensor SA, the light sensor SB, the light sensor SC, and the light sensor SD. In addition, the control unit 25 determines that the stage 5 is at the fourth stage from the top, when the detection results from the light sensors S indicate "transmitted", "transmitted", "blocked", and "transmitted" in the order of the light sensor SA, the light sensor SB, the light sensor SC, and the light sensor SD. In addition, the control unit 25 determines that the stage 5 is at the fifth stage from the top, when the detection results from the light sensors S indicate "transmitted", "blocked", "blocked", and "transmitted" in the order of the light sensor SA, the light sensor SB, the light sensor SC, and the light sensor SD. In addition, the control unit 25 determines that the stage 5 is at the sixth stage from the top, when the detection results from the light sensors S indicate "blocked", "blocked", "blocked", and "transmitted" in the order of the light sensor SA, the light sensor SB, the light sensor SC, and the light sensor SD. In addition, the control unit 25 determines that the stage 5 is at the seventh stage from the top, when the detection results from the light sensors S indicate "blocked", "transmitted", "blocked", and "blocked" in the order of the light sensor SA, the light sensor SB, the light sensor SC, and the light sensor SD. In addition, the control unit 25 determines that the stage 5 is at the eighth stage from the top, when the detection results from the light sensors S indicate "transmitted", "transmitted", "transmitted", and "blocked" in the order of the light sensor SA, the light sensor SB, the light sensor SC, and the light sensor SD. Then, the control unit 25 determines that the stage 5 is at the lowest stage, when the detection results from the light sensors S indicate "transmitted", "blocked", "transmitted", and "transmitted" in the order of the light sensor SA, the light sensor SB, the light sensor SC, and the light sensor SD. In other words, in such a case, the support position of the medium in the facing direction C in the medium supporting unit 2 is determined to be at the furthest to the printing head 7.

Note that in the embodiment, four patterns having the first pattern to the fourth pattern are used, but the number of patterns to be used is not limited to this. The number of patterns to be used may be decided based on the number of stages for changing the support position of the medium. For example, in a pattern utilizing the presence or absence of the hole portion H as in the embodiment, the number of states that can be expressed is an n-th power of 2. Here, n represents the number of patterns to be used, and is an integer of 1 or greater. In the combination of four patterns as in the embodiment, up to 16 states can be expressed. However, if the number of stages for changing the support position of the medium is eight or less, the pattern may be three or less. Conversely, if the number of stages for changing the support position of the medium is 17 or greater, the pattern may be five or greater.

In summary, with the configuration in which the position of the medium supporting unit 2 in the facing direction C is detected based on the combination of the plurality of patterns including the first pattern and the second pattern, the number of states that can be expressed, that is, the number of stages that can be expressed can be increased with a simple configuration. Note that, if the number of stages for changing the support position of the medium is two, the pattern to be used may be one.

Summarizing the above here, the printing apparatus 1 according to the embodiment includes the medium supporting unit 2 configured to support a medium, the printing head 7 configured to carry out printing onto the medium supported by the medium supporting unit 2, and the lever 9 configured to move the stage 5 and the tray 4 being a part of the medium supporting unit 2 in the facing direction C being a direction in which the medium supporting unit 2 and the printing head 7 face each other to change a support position of the medium in the facing direction C. Furthermore, the printing apparatus 1 according to the embodiment includes the detected unit 12 having position information in the facing direction C, the detected unit 12 being configured to move in the facing direction C together with the medium supporting unit 2, the detector 11 configured to detect the position information, and the control unit 25 configured to detect a position of the medium supporting unit 2 in the facing direction C based on the position information detected by the detector 11.

As described above, the printing apparatus 1 according to the embodiment includes the detected unit 12 having position information in the facing direction C, the detected unit 12 being configured to move in the facing direction C together with the medium supporting unit 2, the detector 11 configured to detect the position information, and the control unit 25 configured to detect a position of the medium supporting unit 2 in the facing direction C based on the position information detected by the detector 11, and thus, the printing apparatus 1 can detect, based on a detection result of the position information from the detector 11, the position in the facing direction C of the medium supporting unit 2, that is specifically, the stage 5 and the tray 4.

Alternately stated, the printing apparatus 1 according to the embodiment including the medium supporting unit 2 configured to support a medium, the printing head 7 configured to carry out printing onto the medium supported by the medium supporting unit 2, the lever 9 configured to move at least a part of the medium supporting unit 2 in the facing direction C being a direction in which the medium supporting unit 2 and the printing head 7 face each other to change a support position of the medium in the facing direction C, the detected unit 12 having position information in the facing direction C, the detected unit 12 being configured to move in the facing direction C together with the medium supporting unit 2, and the detector 11 configured to detect the position information, can be used to detect the position of the medium supporting unit 2 in the facing direction C based on the position information detected by the detector 11.

Here, "move at least a part of the medium supporting unit 2 in the facing direction C" means not only moving the entire medium supporting unit 2 in the facing direction C, but also moving only the stage 5 and the tray 4 being a part of component members of the medium supporting unit 2 in the facing direction C, as in the printing apparatus 1 according to the embodiment. In other words, it is sufficient as long as the space in the facing direction C between the medium supported by the medium supporting unit 2 and the printing head 7 can be adjusted. Note that in the printing apparatus 1 according to the embodiment, the stage 5 and the tray 4 are configured separately, but the stage 5 and the tray 4 may be configured integrally. Similarly, "detect the position of the medium supporting unit 2 in the facing direction C" means that it is sufficient as long as the support position of the medium in the facing direction C can be determined by detecting the position in the facing direction C of some of component members of the medium supporting unit 2 such as the stage 5 and the tray 4 configured to move in the facing direction C.

In addition, as described above, the detected unit 12 includes the flat portion 12*a* and the flat portion 12*b* provided in the detected unit 12A, and the flat portion 12*c* and the flat portion 12*d* provided in the detected unit 12B. Furthermore, as described above, the positions of the hole portions H formed in the four flat portions having the flat portion 12*a* to the flat portion 12*d* are different from each other. In other words, the detected unit 12 according to the embodiment has, as the position information in the facing direction C, a configuration different depending on the position in the facing direction C. The detector 11 is configured to detect such a configuration different depending on the position of the detected unit 12 in the facing direction C. Thus, in the printing apparatus 1 according to the embodiment, the detected unit 12 is simply configured, and thus, the position of the medium supporting unit 2 in the facing direction C can be detected with a simple configuration.

Here, the configuration different depending on the position of the detected unit 12 in the facing direction C is specifically a configuration in which a pattern is formed by the hole portion H depending on the position in the facing direction C, as described above. The detector 11 is configured to detect the pattern. Thus, in the printing apparatus 1 according to the embodiment, the detected unit 12 is particularly simply configured, and thus, the position of the medium supporting unit 2 in the facing direction C can be detected with a particularly simple configuration.

Stated from another point of view, it can be expressed that in the printing apparatus 1 according to the embodiment, the detected unit 12 includes the detected unit 12A serving as a first detected unit formed with a first pattern being a pattern formed by the hole portion H, and the detected unit 12B serving as a second detected unit formed with a second pattern being a pattern formed by the hole portion H, the second pattern being different from the first pattern, and the control unit 25 according to the embodiment is configured to detect the position of the medium supporting unit 2 in the facing direction C based on the combination of the plurality of patterns including the first pattern and the second pattern. As described above, the control unit 25 according to the embodiment detects the position of the medium supporting unit 2 in the facing direction C based on the combination of the plurality of patterns including the first pattern and the second pattern, and thus, each of the detected units 12 can be simply configured, and the position of the support portion in the facing direction C can be detected with high accuracy based on detection results from the plurality of detected units 12.

Furthermore, as described above, the lever 9 according to the embodiment is configured to move the medium supporting unit 2 in the facing direction C by an operation involving contact by a user. Thus, in the printing apparatus 1 according to the embodiment, the lever 9 is configured such that the user can easily and intuitively move the medium supporting unit 2 in the facing direction C.

In addition, as described above, in the printing apparatus 1 according to the embodiment, the medium supporting unit 2 is configured to move between the set position being the first position and the printing start position being the second position along the movement direction A intersecting the facing direction C. The first position is a position at which the medium is set on the medium supporting unit 2 by a user. The second position is a start position of the medium supporting unit 2 when printing onto the medium is started. Here, as illustrated in FIG. 5 and the like, the detected unit 12 is provided on a leading side in the direction A1 of the movement direction A, that is, on a side of the second position from the lever 9. As described above, in the printing apparatus 1 according to the embodiment, the detected unit 12 is provided on the rear side from the lever 9 with respect to the position at which the medium is set on the medium supporting unit 2, and thus, the printing apparatus 1 has a configuration such that a situation can be prevented in which the detected unit 12 obstructs user operation when the user operates the lever 9 to move the medium supporting unit 2 in the facing direction C.

In addition, as described above, the detector 11 according to the embodiment is configured to use the light sensor S including the light-emitting unit Se and the light-receiving unit Sr, and thus, is configured to detect the position information in the facing direction C without contacting the detected unit 12. Thus, the printing apparatus 1 according to the embodiment can prevent abrasion of the detector 11 and the detected unit 12 caused by being brought in contact with each other.

Furthermore, in the printing apparatus 1 according to the embodiment, the control unit 25 is configured to transmit, to a display unit such as a monitor of the PC 36 or a panel (not illustrated) formed in the printing apparatus 1, detected information of the position of the medium supporting unit 2 in the facing direction C. Thus, the printing apparatus 1 according to the embodiment is configured to notify the user of the detection result of the position of the medium supporting unit 2 in the facing direction C.

Note that the disclosure is not limited to the aforementioned embodiment, and many variations are possible within the scope of the disclosure as described in the appended claims. It goes without saying that such variations also fall within the scope of the disclosure.

What is claimed is:

1. A printing apparatus comprising:

a support portion configured to support a medium;

a printing unit configured to carry out printing onto the medium supported by the support portion;

a support portion moving unit configured to move at least a part of the support portion in a facing direction, that is a direction in which the support portion and the printing unit face each other, to change a support position of the medium in the facing direction;

at least one detected unit having position information in the facing direction, the detected unit being configured to move in the facing direction together with the support portion;

a detector configured to detect the position information; and a control unit configured to detect a position of the support portion in the facing direction, based on the position information detected by the detector.

2. The printing apparatus according to claim 1, wherein the at least one detected unit has, as the position information, configurations different from each other depending on a position in the facing direction, and the detector is configured to detect the different configurations.

3. The printing apparatus according to claim 2, wherein each of the at least one different configuration is a configuration in which a pattern is formed depending on the position in the facing direction, and the detector is configured to detect the pattern.

4. The printing apparatus according to claim 3, wherein the detected unit includes a first detected unit formed with a first pattern as the pattern and a second detected unit formed with a second pattern as the pattern, the second pattern being different from the first pattern, and the control unit is configured to detect the position of the support portion in the facing direction based on a combination of a plurality of the patterns including the first pattern and the second pattern.

5. The printing apparatus according to claim 1, wherein the support portion moving unit is configured to move the support portion in the facing direction by an operation involving contact by a user.

6. The printing apparatus according to claim 5, wherein the support portion is configured to move between a first position and a second position along a movement direction intersecting the facing direction, the first position is a position at which the medium is set on the support portion by a user, and the second position is a start position of the support portion when printing onto the medium is started, and the detected unit is provided on a side of the second position with respect to the support portion moving unit in the movement direction.

7. The printing apparatus according to claim 1, wherein the detector is configured to detect the position information without contacting the detected unit.

8. The printing apparatus according to claim 1, wherein the control unit is configured to transmit, to a display unit, the detected information of the position of the support portion in the facing direction.

9. A method of detecting a position of a support portion in a printing apparatus, the printing apparatus including:

a support portion configured to support a medium;

a printing unit configured to carry out printing onto the medium supported by the support portion;

a support portion moving unit configured to move at least a part of the support portion in a facing direction, that is a direction in which the support portion and the printing unit face each other, to change a support position of the medium in the facing direction;

at least one detected unit having position information in the facing direction, the detected unit being configured to move in the facing direction together with the support portion; and a detector configured to detect the position information, the method comprising:

detecting a position of the support portion in the facing direction, based on the position information detected by the detector.

* * * * *